US011434792B1

(12) United States Patent
Han et al.

(10) Patent No.: US 11,434,792 B1
(45) Date of Patent: Sep. 6, 2022

(54) MULTI-PIECE CRANKCASE VENTILATION VALVE

(71) Applicants: Anthony J Han, Shelby Township, MI (US); Nizarullah Khan, Farmington Hills, MI (US)

(72) Inventors: Anthony J Han, Shelby Township, MI (US); Nizarullah Khan, Farmington Hills, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 17/350,749

(22) Filed: Jun. 17, 2021

(51) Int. Cl.
*F01M 13/00* (2006.01)
*F01M 13/04* (2006.01)

(52) U.S. Cl.
CPC .... *F01M 13/0011* (2013.01); *F01M 13/0416* (2013.01); *F01M 2013/0433* (2013.01)

(58) Field of Classification Search
CPC .. F01M 13/04; F01M 13/0011; F01M 13/028; F01M 2013/0461; F01M 13/0416
USPC ..... 123/196 A, 572–574, 41.86; 55/512; 264/86; 210/348, 500, 502.1, 506
See application file for complete search history.

(56) References Cited

U.S. PATENT DOCUMENTS 3,359,960 A * 12/1967 Pittsley ..... F01M 13/023 123/574
3,659,573 A * 5/1972 Bennett ..... F01M 13/023 123/574
3,766,898 A * 10/1973 McMullen ..... F01M 13/023 123/574
3,990,420 A * 11/1976 Bitterman ..... F02M 23/09 123/587
4,205,642 A 6/1980 Nishimura et al.
4,602,607 A * 7/1986 Balsley ..... F01M 13/023 123/41.86
5,228,424 A * 7/1993 Collins ..... F01M 13/023 123/574
7,017,564 B2 * 3/2006 Duprez ..... F02M 25/06 123/574
7,311,091 B2 * 12/2007 Duprez ..... F02M 25/06 123/574
7,316,227 B2 * 1/2008 Zhao ..... F02M 25/06 123/574

(Continued)

FOREIGN PATENT DOCUMENTS

DE 102015216533 A1 3/2017
JP 2009264275 A 11/2009

*Primary Examiner* — George C Jin
*Assistant Examiner* — Teuta B Holbrook
(74) *Attorney, Agent, or Firm* — Ralph E. Smith

(57) ABSTRACT

A PCV system includes a PCV valve configured to be inserted into a port formed on a mating component of an engine and regulate a flow of blow-by gases from a crankcase to an intake manifold. A PCV line includes a first end, and a second end configured to fluidly couple to the air intake manifold. A PCV valve cap is coupled to the PCV line first end and configured to further couple to the mating component to secure the PCV valve in the port and establish a fluid coupling with the mating component. The PCV valve is separate and distinct from the PCV valve cap such that a disconnection of the fluid coupling between the PCV line first end and the mating component separates the PCV line from the PCV valve such that the PCV valve no longer regulates flow through the PCV line into the intake manifold.

14 Claims, 4 Drawing Sheets

(56) References Cited

U.S. PATENT DOCUMENTS

| | | | | |
|---|---|---|---|---|
| 8,356,587 | B2 * | 1/2013 | Wade | G05D 7/0133 123/574 |
| 8,955,501 | B2 | 2/2015 | Tanikawa et al. | |
| 9,410,457 | B2 * | 8/2016 | Fujiki | F01M 13/0011 |
| 10,371,026 | B2 * | 8/2019 | Tokunaga | F01M 13/00 |
| 2002/0062869 | A1 * | 5/2002 | Toyokawa | F01M 13/0011 137/515 |
| 2002/0112710 | A1 * | 8/2002 | Akiwa | F01M 13/0416 123/572 |
| 2012/0006306 | A1 * | 1/2012 | Boehm | F01M 13/0011 123/572 |
| 2014/0054486 | A1 * | 2/2014 | Fujiki | G05D 7/0133 251/321 |
| 2014/0096754 | A1 * | 4/2014 | Monros | F01M 13/0011 123/574 |
| 2015/0114369 | A1 | 4/2015 | Tanikawa et al. | |
| 2016/0333753 | A1 * | 11/2016 | Nawa | F02F 7/006 |
| 2019/0017420 | A1 * | 1/2019 | Kashiwabara | F01M 13/04 |

* cited by examiner

MULTI-PIECE CRANKCASE VENTILATION VALVE

FIELD

The present application relates generally to positive crankcase ventilation (PCV) systems for internal combustion engines and, more particularly, to a multi-piece PCV valve and connection for PCV systems.

BACKGROUND

Positive crankcase ventilation (PCV) systems are designed to evacuate blow-by gases from a crankcase of an internal combustion engine. These gases are formed of an air/fuel mixture that escapes the combustion chamber by "blowing by" the piston seals. To avoid corrosion and high pressures in the crankcase that can potentially damage the seals and increase pumping work, the blow-by gases must be vented therefrom. This is typically accomplished by returning the blow-by gases to the intake side of the internal combustion engine where the gases are mixed with the air/fuel mixture and subsequently burned. Further, onboard diagnostics are often required to monitor the PCV system for disconnections or leaks that could exhaust the blow-by gases to the atmosphere. In some systems, however, if a PCV valve is disconnected from a mating component while the crankcase ventilation tube is still attached, no significant intake manifold leak is created since the PCV valve continues to regulate the flow of air into the intake manifold even while disconnected. As such, some current detection systems are not able to diagnose this condition. Thus, while such conventional systems work well for their intended purpose, there remains a desire for improvement in the relevant art.

SUMMARY

According to one example aspect of the invention, a positive crankcase ventilation (PCV) system for a vehicle internal combustion engine having an air intake manifold and a crankcase is provided. In one example configuration, the PCV system includes a PCV valve configured to be inserted into a port formed on a mating component of the engine and regulate a flow of blow-by gases from the crankcase to the intake manifold. A PCV line includes a first end, and a second end configured to fluidly couple to the air intake manifold. A PCV valve cap is coupled to the PCV line first end and configured to further couple to the mating component to secure the PCV valve in the port and establish a fluid coupling with the mating component. The PCV valve is separate and distinct from the PCV valve cap such that a disconnection of the fluid coupling between the PCV line first end and the mating component separates the PCV line from the PCV valve such that the PCV valve no longer regulates flow through the PCV line into the intake manifold, thereby resulting in a leak detectable by an onboard diagnostics system.

In addition to the foregoing, the described PCV system may include one or more of the following features: wherein there are no attachment features between the PCV valve and the PCV valve cap; wherein the PCV valve cap establishes a sealing interface with the PCV valve when coupled to the mating component; wherein the mating component is an oil separator; wherein the mating component is a valve cover; and wherein the PCV valve cap is sized and shaped to be inserted into the port.

According to another example aspect of the invention, an internal combustion engine is provided. In one example configuration, the engine includes a crankcase, a mating component having a port configured to receive blow-by gases from the crankcase, an air induction system including an intake manifold, a positive crankcase ventilation (PCV) system including a PCV valve, a PCV line, and a PCV valve cap. The PCV valve is configured to be inserted into the mating component port and regulate a flow of blow-by gases from the crankcase to the intake manifold. The PCV line includes a first end coupled to the PCV valve cap, and a second end fluidly coupled to the air intake manifold. The PCV valve cap is configured to couple to the mating component to secure the PCV valve in the port and establish a fluid coupling with the mating component. The PCV valve is separate and distinct from the PCV valve cap such that a disconnection of the fluid coupling between the PCV line first end and the mating component separates the PCV line from the PCV valve such that the PCV valve no longer regulates flow through the PCV line into the intake manifold, thereby resulting in a leak detectable by an onboard diagnostics system.

In addition to the foregoing, the described engine may include one or more of the following features: wherein the mating component port defines a counterbore having a smaller counterbore passage and a larger counterbore passage; wherein the PCV valve is inserted into smaller counterbore passage and seats against a first shoulder; wherein the PCV valve cap is inserted into the larger counterbore passage and seats against a second shoulder to create a sealing interface with the PCV valve; wherein the mating component is an oil separator; wherein the mating component is a valve cover; and wherein there are no attachment features between the PCV valve and the PCV valve cap.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

The present application is directed to a positive crankcase ventilation (PCV) system of an internal combustion engine that includes a PCV valve to control the flow of gases into or out of the crankcase. The PCV system includes the PCV valve, a PCV valve cap, and a port for connecting the crankcase ventilation hose. The valve is pressed into a mating component (e.g., valve cover, oil separator, etc.), and the PCV valve cap subsequently holds the PCV valve therein while providing an attachment point for the crankcase ventilation hose. Advantageously, there are no attachment features between the PCV valve and the PCV valve cap, but rather only an established sealing interface therebetween. As such, if the PCV valve cap is disconnected from the mating component with the PCV line still attached, there is nothing to hold the PCV valve in the PCV valve cap. This will result in a significant intake manifold leak, which can be detected by the onboard diagnostics system.

Figure 1:
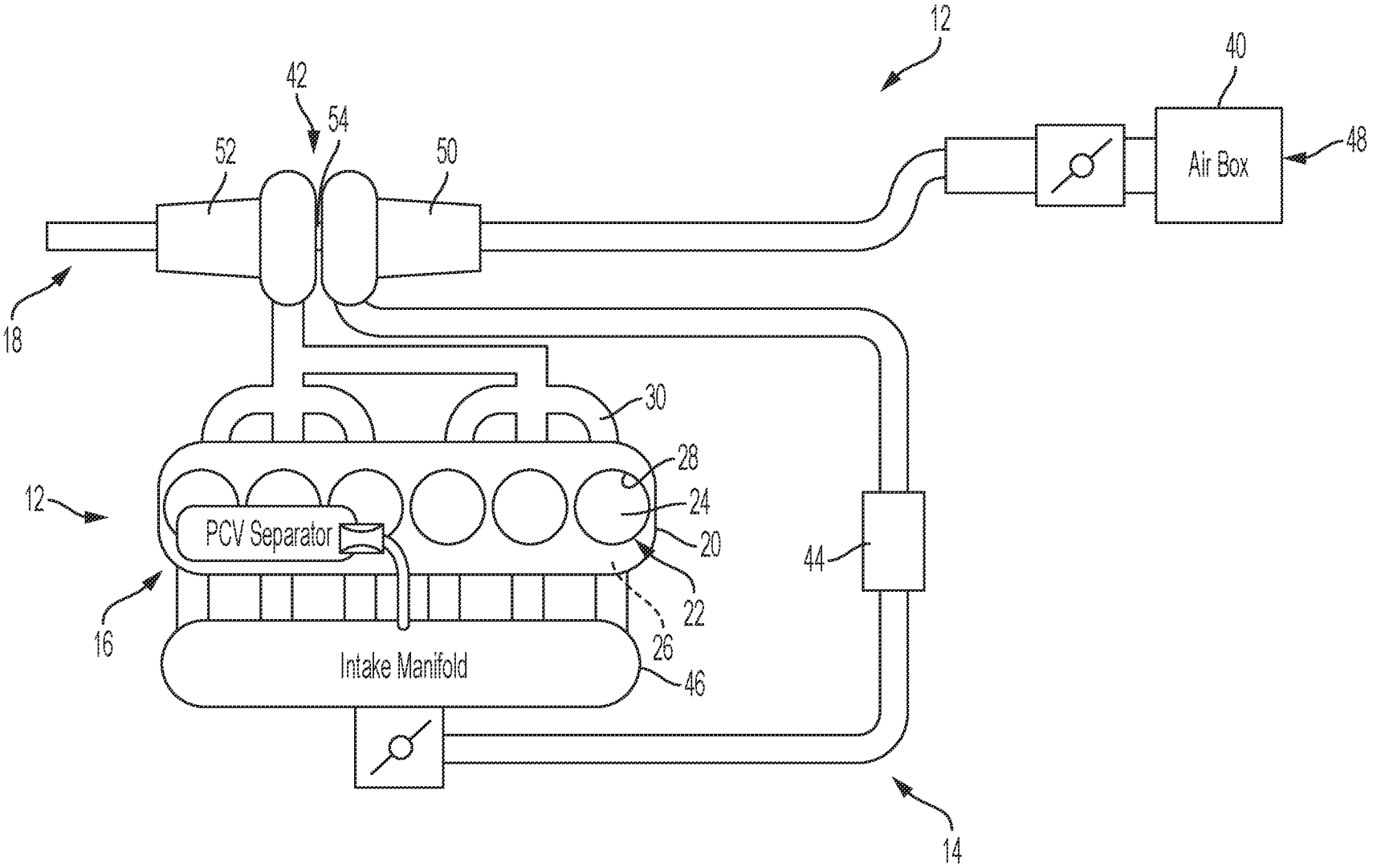
FIG. 1 is a schematic diagram of an example internal combustion engine having a PCV system in accordance with the principles of the present disclosure.

Referring now to the drawings, FIG. 1 is a schematic illustration of an internal combustion engine 12 that generally includes a forced air induction system 14, a PCV system 16, and an exhaust system 18. The engine 12 generally includes a cylinder block 20 defining one or more cylinders 22 to each receive a reciprocating piston 24 therein. An intake port 26 supplies an air/fuel mixture from the forced air induction system 14 to a combustion chamber 28 within the cylinder 22. The air/fuel mixture is ignited in the combustion chamber 28 and the resulting exhaust gas is removed from the chamber via an exhaust port 30. During the combustion, a portion of the exhaust gas can blow by the piston 24 into a crankcase 32 (FIG. 2) of the engine 12. As described herein in more detail, the PCV system 16 recirculates the blow-by gases back to the forced air induction system 14 for further combustion in the combustion chamber 28.

The forced air induction system 14 generally includes an air cleaner 40, a turbocharger 42, a charge air cooler 44, and an intake manifold 46. Air enters the vehicle through an air intake 48 and is filtered in the air cleaner 40 before entering a compressor side 50 of the turbocharger 42. The air is compressed in the turbocharger 42 and subsequently cooled in the charge air cooler 44 before being delivered to the intake port 26 via the intake manifold 46. After combustion, the exhaust gas is removed from the combustion chamber 28 through exhaust port 30 before being directed to a turbine side 52 of the turbocharger 42. The exhaust gas drives the turbine side 52, which drives the turbocharger compressor side 50 via a shaft 54, and the exhaust gas is subsequently directed to the vehicle exhaust system 18. It will be appreciated, however, that the PCV systems described herein may also be utilized with other engine types such as naturally aspirated engines.

Figure 2:
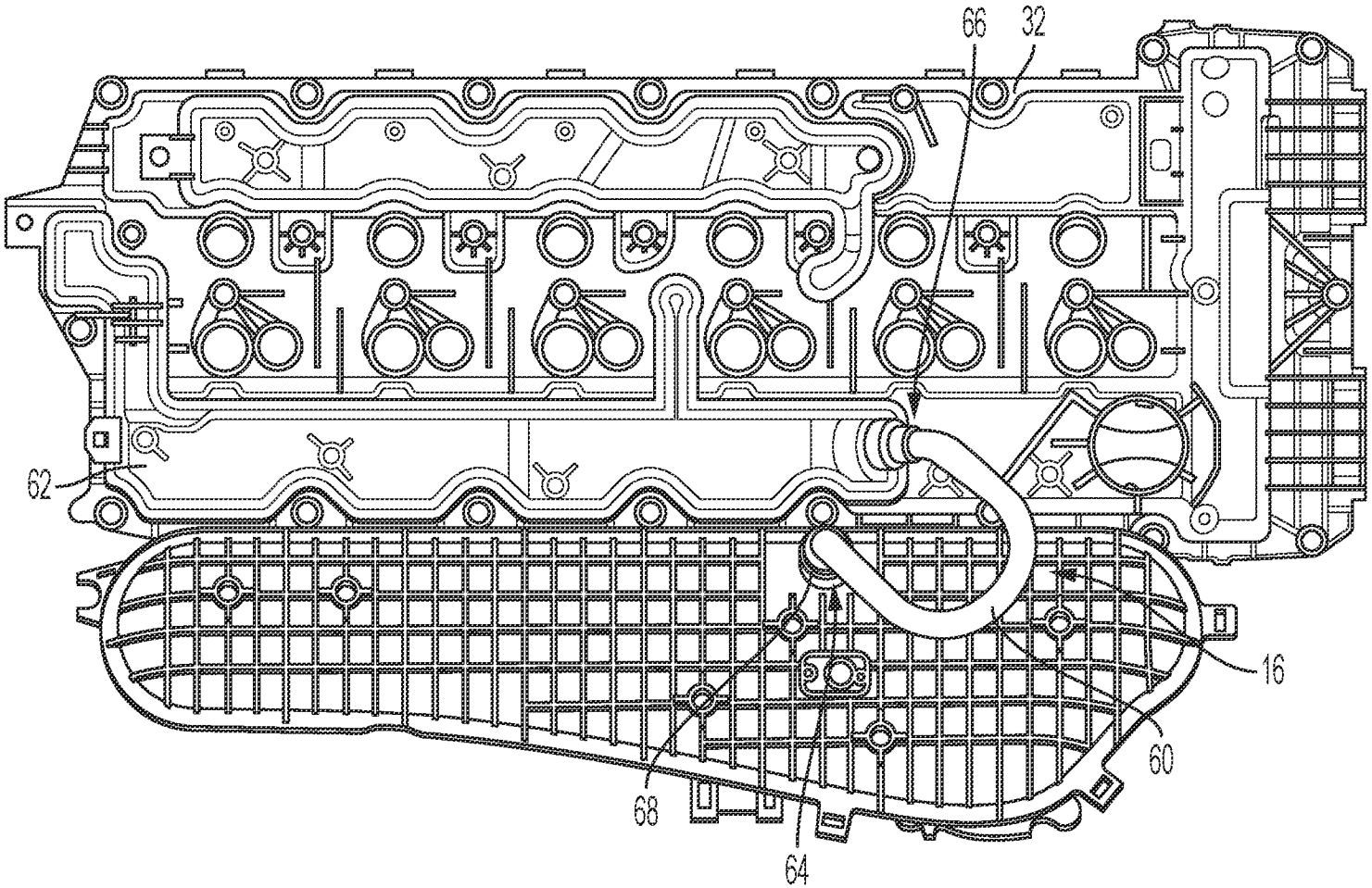
FIG. 2 is a perspective view of an example PCV system coupled between an intake manifold and crankcase of the engine, in accordance with the principles of the present disclosure.

With additional reference to FIGS. 2-4, the PCV system 16 will be described in more detail. In the example embodiment, PCV system 16 generally includes a PCV hose or line 60 and an oil separator 62 fluidly connected between the crankcase 32 and the intake manifold 46 to vent blow-by gases from the crankcase 32 to the intake manifold 46 under naturally aspirated conditions. The oil separator 62 is configured to remove oil from the blow-by gases as they are directed from the crankcase 32 to the intake manifold 46. As shown, PCV line 60 includes a first end 64 and an opposite second end 66. The first end 64 is coupled to a port 68 on the intake manifold 46, and the second end 66 is configured to couple to one end of a PCV valve cap 70 (see FIG. 3).

As described herein in more detail, the PCV valve cap 70 is configured to couple to a mating component 72 (shown as oil separator 62) over a PCV valve 74 with an outer housing 75, which is configured to regulate the flow of blow-by gases from the crankcase 32 to the intake manifold 46. Additionally, PCV valve 74 is configured to limit flow from the intake manifold 46 back to the crankcase 32 under boost conditions. It will be appreciated the PCV valve as described herein is not limited to the described system and may be any valve that controls or regulates the flow of blow-by gases into or out of the crankcase of an engine.

Figure 3:
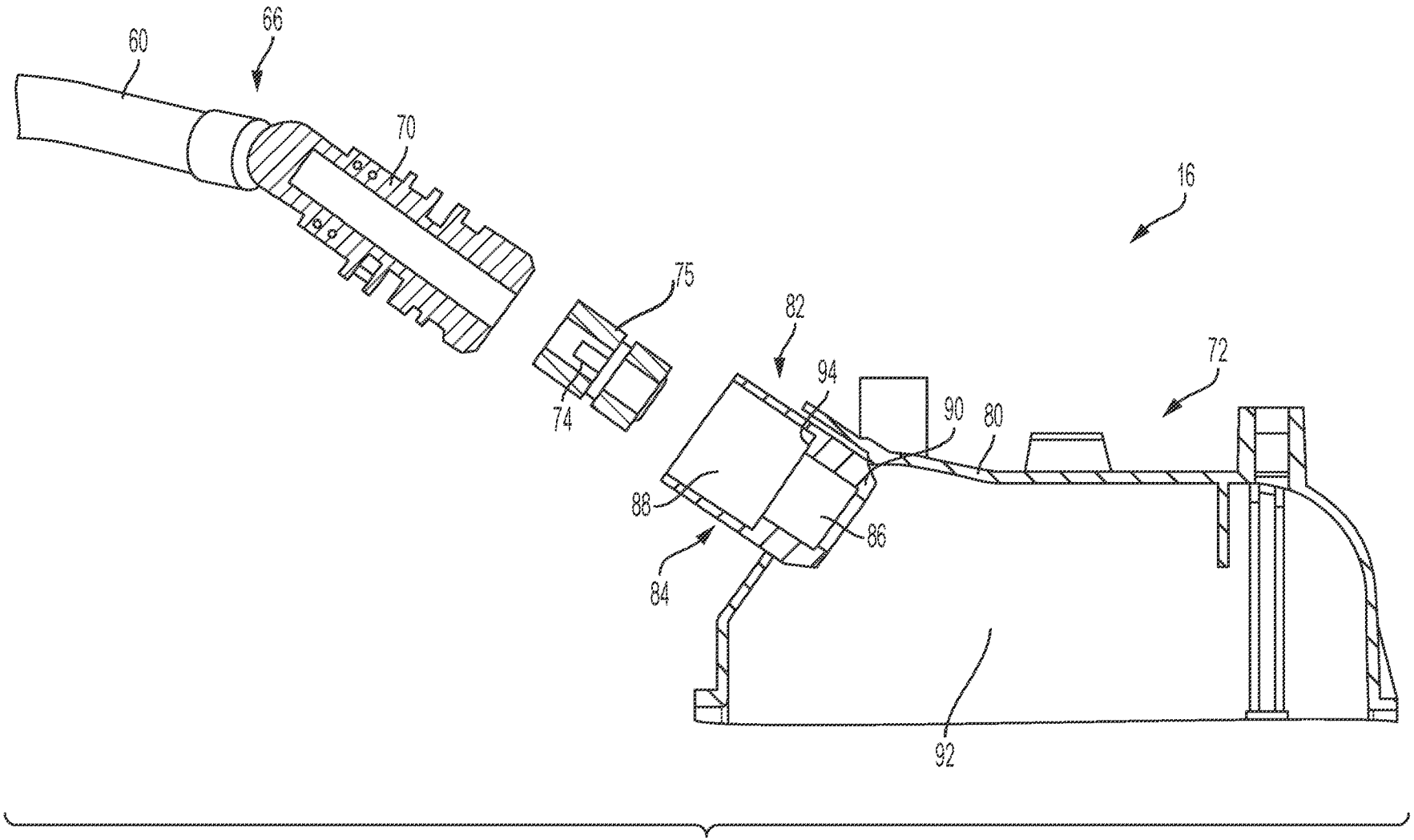
FIG. 3 is a sectional view of an example connection of the PCV system shown in FIG. 1, before assembly, in accordance with the principles of the present disclosure.
Figure 4:
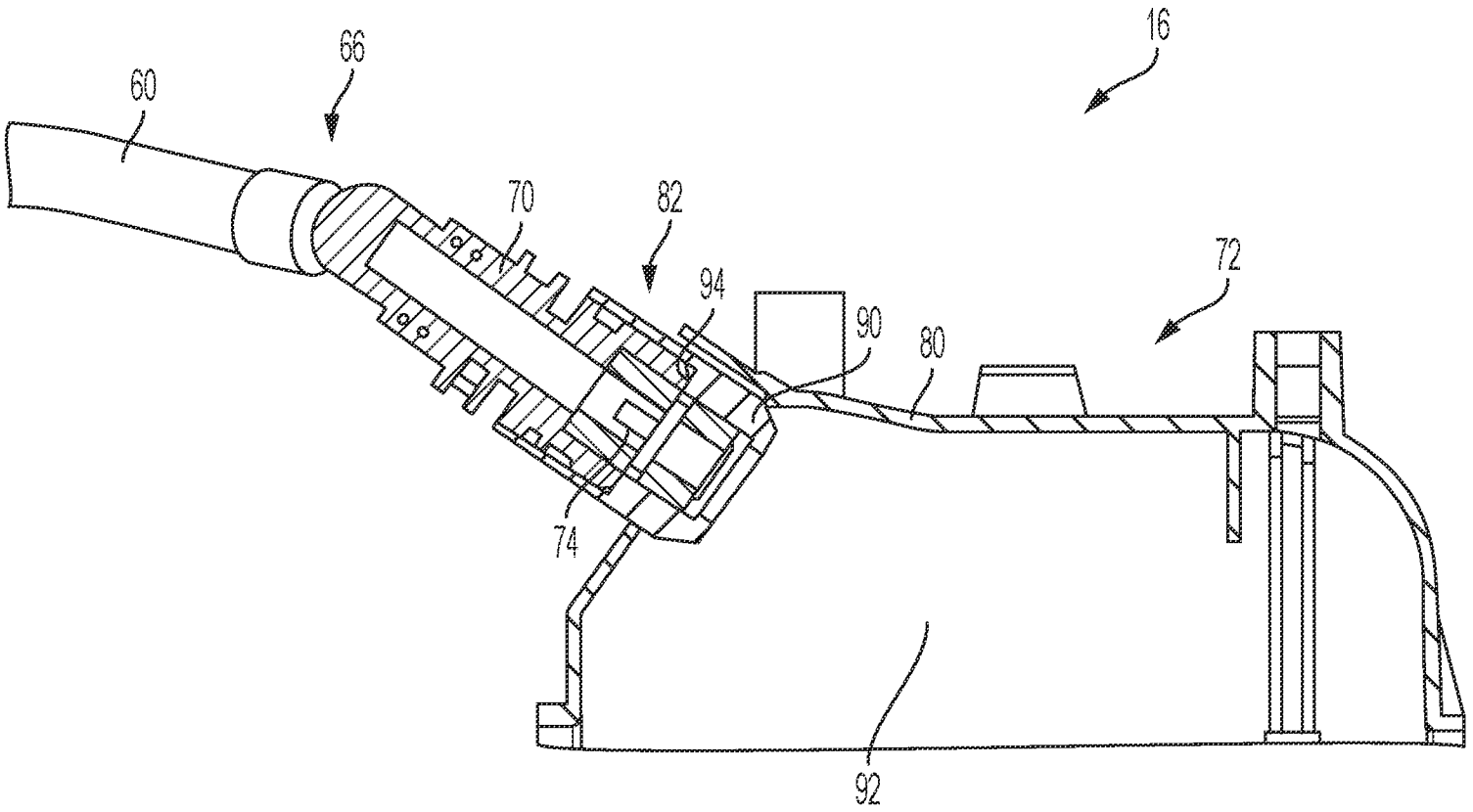
FIG. 4 is a sectional view of the PCV system connection shown in FIG. 3, after assembly, in accordance with the principles of the present disclosure.

With further reference to FIGS. 3 and 4, the fluid coupling or connection between the PCV line 60 and the mating component 72 will be described in more detail. In the example embodiment, the mating component 72 is the oil separator 62, but it will be appreciated that the mating component may be other suitable components such as, for example, a valve cover. As shown, the mating component 72 includes a housing wall 80 with a PCV port 82 extending outwardly therefrom. The PCV port 82 defines a counterbore 84 having a smaller passage 86 and a larger passage 88. A first shoulder 90 is formed at one end of the smaller passage 86 as it connects to a cavity 92 formed within the housing wall 80, and a second shoulder 94 is formed at the transition between the smaller passage 86 and the larger passage 88.

As shown in FIG. 3, unlike conventional systems, the PCV valve 74 is separate and distinct from the PCV valve cap 70. During assembly, the PCV valve 74 is inserted into the PCV port 82 into the smaller counterbore passage 86 until it seats against the first shoulder 90, as shown in FIG. 4. The PCV valve cap 70, which is coupled to the PCV line 60, is then inserted into the larger counterbore passage 88 until it seats against the second shoulder 94 and establishes a sealing interface with the PCV valve 74. In some alternative arrangements, an outer surface of the PCV valve cap 70 can be threaded to an inner surface of the larger counterbore passage 80.

Because the PCV valve 74 is separate and distinct from the PCV valve cap 70, a disconnection of the PCV line 60 from the mating component 72 is detectable, unlike conventional PCV systems where a PCV valve remains attached to the PCV line when it is disconnected from the mating component. In such a condition in the conventional system, it is possible for blow-by gases to escape to atmosphere, since little or no intake manifold leak is created due to the PCV valve being attached to the PCV line and still regulating the flow of air into the intake manifold. In contrast, the current system advantageously prevents such a condition by separating the PCV cap 70 from the regulating portion of the PCV valve 74. This prevents the PCV valve 74 from being removed from the mating component 72 with the PCV line 60 still attached. As such, if the PCV valve cap 70 is disconnected from the mating component 72 with the PCV line 60 still attached, there is nothing to hold the PCV valve 74 in the PCV valve cap 70. Such a disconnection would result in a significant intake manifold leak, which is detectable by the onboard diagnostics system.

Described herein are systems and methods for a PCV system capable of enabling detection of a disconnection between the upstream end of a PCV line and a mating component such as the oil separator. The PCV line upstream end is attached to a PCV valve cap, which is separate and distinct from the regulating PCV valve. The PCV valve is inserted into a port in the mating component and the PCV valve cap is attached to the port to seal with and hold the PCV valve in place. In the event of a disconnection of the PCV line and PCV valve cap from the mating component, the PCV valve remains in place since it is not attached to the PCV valve cap. Since the PCV valve will no longer regulate the flow of air through the PCV line into the intake manifold, a detectable leak is established for the onboard diagnostics system.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. A positive crankcase ventilation (PCV) system for a vehicle internal combustion engine having an air intake manifold and a crankcase, the PCV system comprising:

a PCV valve having an outer housing configured to be inserted into a port formed on a mating component of the engine and regulate a flow of blow-by gases from the crankcase to the intake manifold;

a PCV line having a first end, and a second end configured to fluidly couple to the air intake manifold; and a PCV valve cap coupled to the PCV line first end and configured to further couple to the mating component to secure the PCV valve in the port and establish a fluid coupling with the mating component, wherein the PCV valve is separate and distinct from the PCV valve cap such that a disconnection of the fluid coupling between the PCV line first end and the mating component separates the PCV line from the PCV valve such that the PCV valve no longer regulates flow through the PCV line into the intake manifold, thereby resulting in a leak detectable by an onboard diagnostics system.

2. The PCV system of claim 1, wherein there are no attachment features between the PCV valve and the PCV valve cap.

3. The PCV system of claim 1, wherein the PCV valve cap establishes a sealing interface with the PCV valve when coupled to the mating component.

4. The PCV system of claim 1, wherein the mating component is an oil separator.

5. The PCV system of claim 1, wherein the mating component is a valve cover.

6. The PCV system of claim 1, wherein the PCV valve cap is sized and shaped to be inserted into the port.

7. An internal combustion engine comprising:

a crankcase;

a mating component having a port configured to receive blow-by gases from the crankcase;

an air induction system including an intake manifold;

a positive crankcase ventilation (PCV) system including a PCV valve, a PCV line, and a PCV valve cap, wherein the PCV valve includes an outer housing and is configured to be inserted into the mating component port and regulate a flow of blow-by gases from the crankcase to the intake manifold, wherein the PCV line includes a first end coupled to the PCV valve cap, and a second end fluidly coupled to the air intake manifold, wherein the PCV valve cap is configured to couple to the mating component to secure the PCV valve in the port and establish a fluid coupling with the mating component, wherein the PCV valve is separate and distinct from the PCV valve cap such that a disconnection of the fluid coupling between the PCV line first end and the mating component separates the PCV line from the PCV valve such that the PCV valve no longer regulates flow through the PCV line into the intake manifold, thereby resulting in a leak detectable by an onboard diagnostics system.

8. The engine of claim 7, wherein the mating component port defines a counterbore having a smaller counterbore passage and a larger counterbore passage, and wherein the PCV valve cap is removably coupled to the port.

9. The engine of claim 8, wherein the PCV valve is inserted into the smaller counterbore passage and seats against a first shoulder, and wherein the mating component includes a housing wall defining a cavity, and wherein the port extends outwardly from housing wall.

10. The engine of claim 9, wherein the PCV valve cap is inserted into the larger counterbore passage and seats against a second shoulder to create a sealing interface with the PCV valve.

11. The engine of claim 8, wherein the PCV valve is removably coupled to the port via threading to an inner surface of the port.

12. The engine of claim 7, wherein the mating component is an oil separator.

13. The engine of claim 7, wherein the mating component is a valve cover.

14. The engine of claim 7, wherein there are no attachment features between the PCV valve and the PCV valve cap.

* * * * *